US005092313A

United States Patent [19]

Blackburn et al.

[11] Patent Number: 5,092,313

[45] Date of Patent: Mar. 3, 1992

[54] GAS LOG FIREPLACE WITH HIGH HEAT OUTPUT

[75] Inventors: Richard S. Blackburn, South Royalton, Vt.; William A. Byrne, Fernhill Heath, England; Stephen F. Richardson, Randolph Center; Robert W. Ferguson, South Royalton, both of Vt.

[73] Assignee: Vermont Castings, Inc., Randolph, Vt.

[21] Appl. No.: 681,868

[22] Filed: Apr. 5, 1991

[51] Int. Cl.[5] ..... F24C 3/00

[52] U.S. Cl. ..... 126/512; 126/83; 126/85 B; 126/92 AC; 126/523; 126/531; 431/125

[58] Field of Search ..... 126/512, 85 B, 92 R, 126/92 AC, 90 R, 523, 528, 500, 531, 80, 83, 92 B, 85 R, 503, 77; 431/125, 110, 112

[56] References Cited

U.S. PATENT DOCUMENTS

| | | | |
|---|---|---|---|
| D. 245,993 | 10/1977 | Anderson et al. | D23/93 |
| D. 273,321 | 4/1984 | Cosper | D23/90.1 |
| 3,042,109 | 7/1962 | Peterson | 158/113 |
| 3,291,116 | 12/1986 | Brooks | 126/92 |
| 3,362,395 | 1/1968 | Peterson | 126/92 |
| 3,382,861 | 5/1968 | Peterson | 126/92 |
| 3,543,741 | 12/1970 | Whitehead | 126/92 |
| 3,696,801 | 10/1972 | Whitehead | 126/92 R |
| 3,723,046 | 3/1973 | Poling et al. | 431/18 |
| 3,747,585 | 7/1973 | Coats | 126/92 |
| 3,760,790 | 9/1973 | Voges et al. | 126/92 R |
| 3,805,762 | 4/1974 | Nelson | 126/4 |
| 3,817,686 | 6/1974 | Quittner | 431/125 |
| 3,842,821 | 10/1974 | Juris | 126/125 |
| 3,871,355 | 3/1975 | Henry | 126/127 |
| 4,000,732 | 1/1977 | White | 126/92 R |
| 4,061,133 | 12/1977 | Swain | 126/350 R |
| 4,306,537 | 12/1981 | Mitchell | 126/92 AC |
| 4,502,463 | 3/1985 | Gregory | 126/121 |
| 4,542,735 | 9/1985 | Smith | 126/512 |
| 4,573,446 | 3/1986 | Rosiek et al. | 126/92 R |
| 4,573,905 | 4/1986 | Meyers | 431/125 |
| 4,582,478 | 4/1986 | Hilker | 431/125 |
| 4,602,609 | 7/1986 | Wright | 126/92 AC |
| 4,637,372 | 1/1987 | Mogol et al. | 126/127 |
| 4,793,322 | 12/1988 | Shimek et al. | 126/512 |
| 4,875,464 | 10/1989 | Shimek et al. | 126/92 AC |
| 4,886,445 | 12/1989 | Richardson | 431/125 |
| 4,971,030 | 11/1990 | Thow et al. | 431/125 |
| 4,976,253 | 12/1990 | Beal et al. | 126/512 |

FOREIGN PATENT DOCUMENTS

| | | | |
|---|---|---|---|
| 2156507 | 10/1985 | United Kingdom . | |
| 2179438 | 3/1987 | United Kingdom | 126/92 R |
| 2185100 | 7/1987 | United Kingdom | 126/92 AC |
| 2208703 | 4/1989 | United Kingdom | 126/92 R |

*Primary Examiner*—James C. Yeung
*Attorney, Agent, or Firm*—Wolf, Greenfield & Sacks

[57] ABSTRACT

A gas log fireplace includes a firebox which defines a combustion chamber, a gas burner located within the firebox, an artificial log set, a log support member positioned on the gas burner, a heat exchanger connected to an exhaust gas outlet of the firebox and a convection chamber which surrounds the firebox and the heat exchanger for heating of room air. The gas burner is fabricated of a refractory fiber material. A combustible gas and primary air are mixed in a Venturi inlet tube of the gas burner. Highly aerated gas flows through front ports and top ports in the gas burner. Secondary air is directed to the front ports and the top ports to obtain highly efficient combustion and high heat output. The artificial log set, the support member and the gas burner define a partially enclosed cavity which is maintained at a high temperature during operation by reradiation from the artificial logs, the support member and the gas burner. The heat exchanger includes an interior rib configuration that provides efficient transfer of heat to room air.

27 Claims, 7 Drawing Sheets

GAS LOG FIREPLACE WITH HIGH HEAT OUTPUT

FIELD OF THE INVENTION

This invention relates to gas burning fireplaces which utilize an artificial log set to provide a decorative and realistic appearance and, more particularly, to a gas log fireplace which has high heat output and high combustion efficiency.

BACKGROUND OF THE INVENTION

Fireplaces which burn gas and which utilize artificial log assemblies to simulate the appearance of burning wood logs are well known in the art. The artificial log assemblies typically include several artificial logs of a ceramic or other refractory material designed to simulate the appearance of wood logs. A gas burner supplies a flammable gas underneath the artificial logs. The gas is burned to produce a flame in the vicinity of the logs. The fireplace can include a tank or reservoir for holding the flammable gas or can be connected to a remote gas source. Fireplaces utilizing artificial log assemblies provide heat and the pleasing appearance of a wood fire, while avoiding the inconvenience and lack of cleanliness associated with the loading of wood into and removal of ashes from conventional wood burning fireplaces.

One objective in the design and construction of gas log fireplaces is to provide artificial logs that look like real logs and to provide gas flames which closely simulate the flames produced by burning wood so that an overall effect of burning wood is produced. Both the size and color of the flame and its position relative to the artificial logs are important in producing a realistic effect. Other important objectives in the design and construction of gas log fireplaces include providing high heat output, providing high combustion efficiency, minimizing the soot and noxious gases produced by combustion and minimizing the cost of the fireplace.

Artificial log assemblies and gas log fireplaces have been disclosed in a number prior art patents, including U.S. Pat. Nos. 4,886,445 (Richardson); 3,543,741 (Whitehead); 3,747,585 (Coats); 3,696,801 (Whitehead); 4,582,478 (Hilker); 4,637,372 (Mogol et al); 3,760,790 (Voges et al); 3,817,686 (Quittner); 3,871,355 (Henry); Des. 245,993 (Anderson et al); 4,306,537 (Mitchell); 3,805,762 (Nelson); 3,842,821 (Juris); 4,573,446 (Rosiek et al); 4,602,609 (Wright); 4,502,463 (Gregory); Des. 273,321 (Cosper); 4,573,905 (Myers); 3,723,046 (Poling et al); 4,061,133 (Swain); 4,000,732 (White); 3,362,395 (Peterson); 3,042,109 (Peterson); 3,291,116 (Brooks); and 3,382,861 (Peterson). A gas burner fabricated of a refractory fiber material is disclosed in U.K. Patent No., 2,156,507, published Oct. 9, 1985.

Prior art gas log fireplaces have had various disadvantages, including an unrealistic appearance, low heat output, low combustion efficiency and excessive complexity. The heat output from prior art gas log fireplaces typically does not exceed about 15,000 to 20,000 BTU's/hour and the overall efficiency does not exceed about 65%.

It is a general object of the present invention to provide an improved gas log fireplace.

It is another object of the present invention to provide a gas log fireplace having an appearance which closely simulates the appearance of burning wood logs.

It is a further object of the present invention to provide a gas log fireplace having high heat output and high overall efficiency.

It is yet another object of the present invention to provide a gas log fireplace having high combustion efficiency.

It is still another object of the present invention to provide a gas log fireplace which is simple in construction and low in cost.

SUMMARY OF THE INVENTION

According to the present invention, these and other objects and advantages are achieved in a gas log fireplace comprising a firebox defining a combustion chamber, the firebox including an air inlet and an exhaust gas outlet, a gas burner located within the firebox, the gas burner comprising a refractory- fiber insulating body having a plurality of front ports in a front surface thereof, a plurality of top ports in a top surface thereof, an inlet for receiving a combustible gas and primary air, and an interior chamber connecting the inlet to the front ports and to the top ports, means for supplying a combustible gas to the inlet of the gas burner, a support member comprising a refractory fiber insulating body positioned on the gas burner, an artificial log set at least partially supported by the support member and positioned relative to the gas burner and the support member so that the log set, the support member and the gas burner define a partially enclosed cavity, the top ports of the gas burner being positioned to direct aerated combustible gas into the cavity, means for directing secondary air from the air inlet of the firebox to the cavity so that the aerated combustible gas is efficiently burned in the cavity, a heat exchanger connected to the exhaust gas outlet of the firebox for receiving exhaust gas from the combustion chamber, and means for directing room air over the firebox and the heat exchanger for heating of the room air.

The artificial log set typically includes a front log positioned at least in part forwardly of the front surface of the gas burner, and a top log and a back log resting on the support member. The support member preferably includes a pair of side walls and a rear wall extending between and attached to the side walls. The side walls and the rear wall of the support member in part define the cavity. Preferably, the rear wall of the support member is spaced from the top surface of the gas burner to define an opening therebetween, and the means for directing secondary air to the cavity comprises the opening between the rear wall of the support member and the top surface of the gas burner. The means for directing secondary air to the cavity preferably further comprises at least one passage extending from a rear surface of the gas burner to the top surface of the gas burner adjacent to the top ports for enhancing flow of secondary air to the cavity.

Heat is reradiated by the artificial log set, the support member and the top surface of the gas burner so that the interior of the cavity is maintained at a temperature on the order of 1300° F.–1800° F. during operation. The gas burner is fabricated of a refractory fiber material and can withstand temperatures on the order of 1200° C. or greater during operation. By maintaining a high temperature within the cavity and by providing sufficient primary and secondary air near the base of the flames in the cavity, high heat output and high combustion efficiency are obtained.

Preferably, the front ports of the gas burner are vertically oriented and are spaced apart along the front surface of the gas burner below the front log. The front ports are positioned to direct aerated combustible gas into a region below the front log. The gas log fireplace preferably further includes means for directing secondary air from the air inlet of the firebox to the region of the front ports below the front log so that the aerated combustible gas passing through the front ports is efficiently burned. The gas burner preferably further includes a forwardly extending vertical rib between each pair of front ports so that each of the front ports generates a substantially independent flame. The artificial log set preferably further includes an ember strip positioned forwardly of the front ports in the gas burner for providing a decorative ember like glow and for reradiating heat to the region of the front ports.

The means for directing room air over the firebox and the heat exchanger preferably includes means defining at least one passage contacting an outer surface of the firebox and an outer surface of the heat exchanger. In a preferred embodiment, the passage is defined by an outer shell which surrounds the firebox and the heat exchanger. Room air flows through the passage by natural or forced convection. One or more optional fans can be used for forcing room air through the passage.

The heat exchanger includes a housing defining an interior region for flow of exhaust gases, at least one exhaust gas inlet connected to the firebox and an exhaust gas outlet connected to a vent pipe. The heat exchanger housing preferably includes a top wall having a first plurality of arcuate, parallel top ribs extending between the exhaust gas inlet and the exhaust gas outlet of the heat exchanger for directing exhaust gas through a major portion of the interior of the housing. The housing preferably further includes a bottom wall having a second plurality of arcuate, parallel bottom ribs extending between the exhaust gas inlet and the exhaust gas outlet of the heat exchanger for directing gas through the major portion of the interior region of the housing. The top ribs and the bottom ribs are interleaved with each other. The heat exchanger preferably further includes a full height rib extending from the top wall to the bottom wall between the exhaust gas inlet and the exhaust gas outlet for preventing direct flow of exhaust gases from the exhaust gas inlet to the exhaust gas outlet of the heat exchanger. The heat exchanger further includes exterior fins for enhancing transfer of heat to the room air.

The artificial log set and the associated gas flames are highly realistic in appearance and closely simulate the appearance of burning wood logs. In addition, the gas log fireplace of the invention provides a heat output on the order of at least 29,000 BTU's per hour and an overall efficiency of at least 80% at a high heat setting, and a heat output of at least 24,000 BTU's per hour and an overall efficiency of at least 78% at a low heat setting.

According to another aspect of the invention, there is provided a gas log appliance comprising a firebox defining a combustion chamber and including an air inlet and an exhaust gas outlet, a gas burner located within the firebox, the gas burner comprising a refractory fiber insulating body having a plurality of front ports in a front surface thereof, a plurality of top ports in a top surface thereof, an inlet for receiving a combustible gas and primary air, and an interior chamber connecting the inlet to the front ports and to the top ports, means for supplying a combustible gas to the inlet of the gas burner, a support member comprising a refractory fiber insulating body positioned on the gas burner, an artificial log set at least partially supported by the support member and positioned relative to the gas burner and the support member so that the log set, the support member and the gas burner define a partially enclosed cavity, the top ports of the gas burner being positioned to direct aerated combustible gas into the cavity, and means for directing secondary air from the air inlet of the firebox to the cavity so that the aerated combustible gas is efficiently burned in the cavity.

BRIEF DESCRIPTION OF THE DRAWINGS

For a better understanding of the present invention, together with other and further objects, advantages and capabilities thereof, reference is made to the accompanying drawings which are incorporated herein by reference and in which.

DETAILED DESCRIPTION OF THE INVENTION

Figure 1:
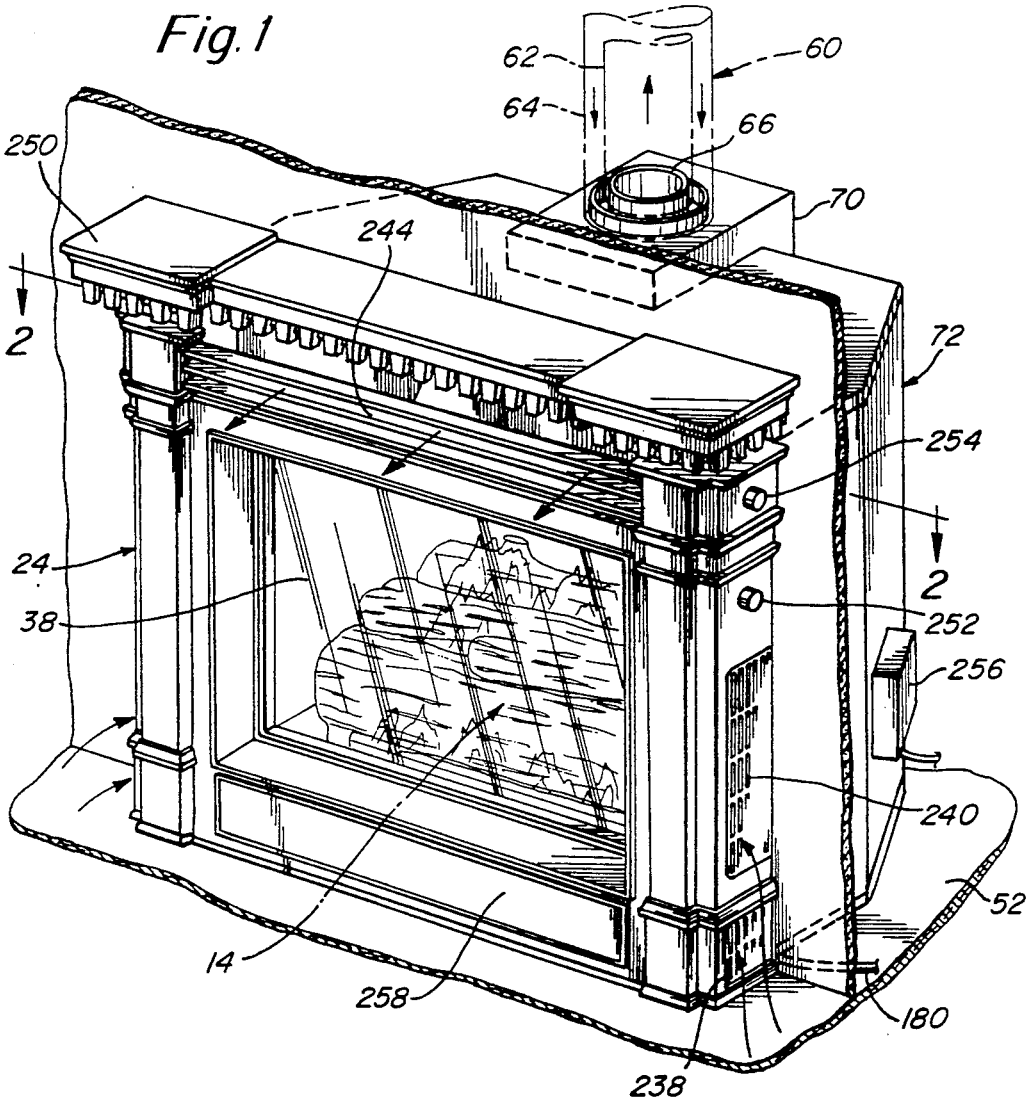
FIG. 1 is a perspective view of a gas log fireplace in accordance with the present invention.

A preferred embodiment of a gas log fireplace in accordance with the present invention is shown in FIGS. 1-9. The principal components of the gas log fireplace are a firebox 10 which encloses a combustion chamber 12, an artificial log and gas burner assembly 14 located within combustion chamber 12, a heat exchanger 16 connected to an exhaust gas outlet of combustion chamber 12, a gas control assembly 18, means for convection flow of room air over the firebox 10 and heat exchanger 16, means for supplying combustion air to the firebox 10 and a front mantel assembly 24 and associated controls. As described below, the construction of the gas log fireplace provides a realistic simulation of burning wood logs, high heat output and high combustion efficiency.

The firebox 10 includes a top wall 30, side walls 32 and 34 and a rear wall 36, preferably fabricated of cast iron The front of the firebox 10 is closed by a transparent window 38 which is held in place by glass clips 40 and is sealed to the firebox walls by gaskets 42. The bottom of the firebox 10 is defined generally by a burner pan 44 and a metal heat shield 46 spaced below burner pan 44. The firebox 10 further includes cast iron supports 48 and 50 which support burner pan 44 and the firebox walls above a floor 52. The firebox 10 includes an air inlet 54 for receiving combustion air and exhaust gas pipes 56 and 58 for directing exhaust gas from combustion chamber 12 to heat exchanger 16.

The gas log fireplace of the invention preferably utilizes a direct vent system for supplying air to combustion chamber 12 and for removing exhaust gases from the gas log fireplace. A vent pipe 60, which extends from the gas log fireplace to the exterior of the home, includes an inner pipe 62 and a concentric outer pipe 64. The inner pipe 62 is connected to an exhaust gas outlet 66 of heat exchanger 16 and carries exhaust gases to the outside of the home. The outer pipe 64 connects to a conduit 70 which extends downwardly along the rear surface of an outer shell 72 of the gas log fireplace and connects to the air inlet 54 of firebox 10. Air is drawn downwardly through outer pipe 64, conduit 70 and air inlet 54 to the combustion chamber 12 to provide oxygen for combustion. This arrangement has the advantage that air from outside the home, rather than room air, is used for combustion so that the oxygen within the home is not depleted. Furthermore, the combustion air is preheated as it passes over the inner pipe 62 and through conduit 70, thereby increasing the operating efficiency of the fireplace. After combustion, the exhaust gases flow from combustion chamber 12 through heat exchanger 16 and inner pipe 62 to the outside of the home. As a result, the combustion air and the exhaust gases are entirely isolated from the interior of the home. Alternatively, room air can be provided to the air inlet of firebox 10.

The artificial log and gas burner assembly 14 includes a gas burner 80, a support member 82 and an artificial log set, typically comprising a front log 84, a top log 86 and a back log 88. The gas burner 80 rests in the burner pan 44 and receives a combustible gas through a main gas line 90. The gas burner 80 is fabricated of a vacuum formed refractory fiber material which acts as a thermal insulator. A preferred fiber material is PROCAL HTSB available from Dyson of Staffordshire, United Kingdom. During operation, the exterior surface of the gas burner 80 becomes sufficiently hot to glow, while the interior passages of the gas burner remain relatively cool. The gas burner 80 includes an inlet 92 for receiving a combustible gas and primary air. An interior chamber 94 in the gas burner 80 is connected to inlet 92, to front ports 96 and to top ports 98 and 99. The front ports 96 are preferably vertical and are spaced apart across a front surface 100 of gas burner 80. In a preferred embodiment, each of the front ports 96 has a width of about 0.059 inch and a length of about 0.669 inch. Preferably, the front ports 96 are located at the lower portion of front surface 100. In a preferred embodiment, a vertical flute or rib 102 is provided between each pair of front ports 96. The ribs 102 can have an arcuate cross section and extend forwardly relative to front ports 96 by about 0.37 inch. The ribs 102 provide a separation between flames from each of the front ports 96 and prevent one flame from taking air from an adjacent port.

The top ports 98 and 99 are located on a top surface 104 of gas burner 80 and are positioned to provide a desired flame pattern. In a preferred embodiment, three top ports 98 are approximately centered from front to back on top surface 104, and a single top port 99 is located forwardly of ports 98. Typically, the top ports 98 and 99 are oriented with their long dimensions parallel to the front of the fireplace. In a preferred embodiment, each of the top ports 98 has a width of 0.078 inch and a length of 1.375 inches, and the top port 99 has a width of 0.078 inch and a length of 1.97 inches.

The inlet 92 of gas burner 80 has the form of a Venturi tube for mixing of combustible gas and air that is directed into interior chamber 94. The main gas line 90 is connected to a nozzle 106 that is spaced from inlet 92. When a combustible gas is directed from nozzle 106 into inlet 92, primary air is drawn into the gas burner and is mixed with the combustible gas. As a result, highly aerated gas flows through front ports 96 and top ports 98, 99. In a preferred embodiment, the Venturi tube at inlet 92 has a throat diameter of about 0.63 inch and a length of about 3 inches.

Figure 6:
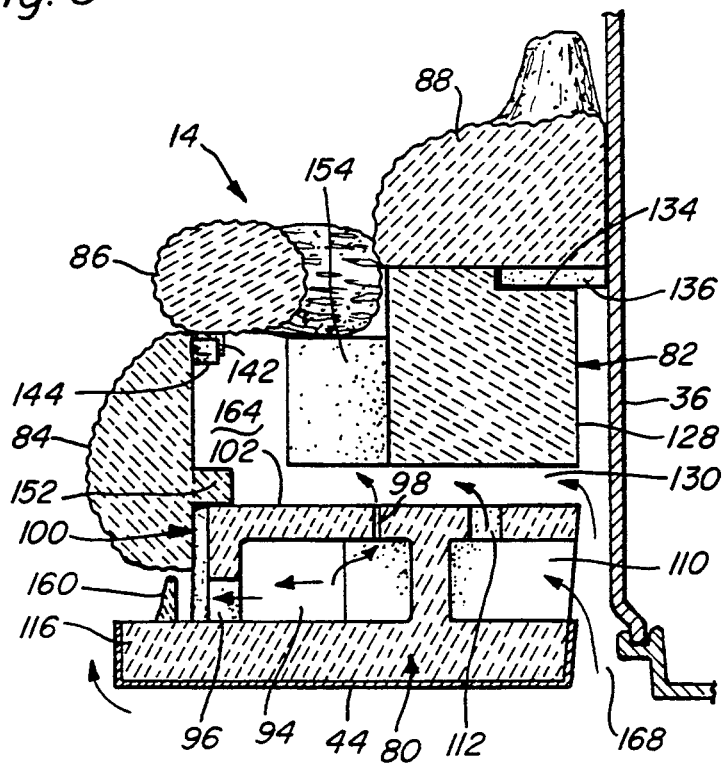
FIG. 6 is a cross-sectional side view of the gas burner, support member and artificial log set taken along the line 6—6 of FIG. 5.
Figure 7:
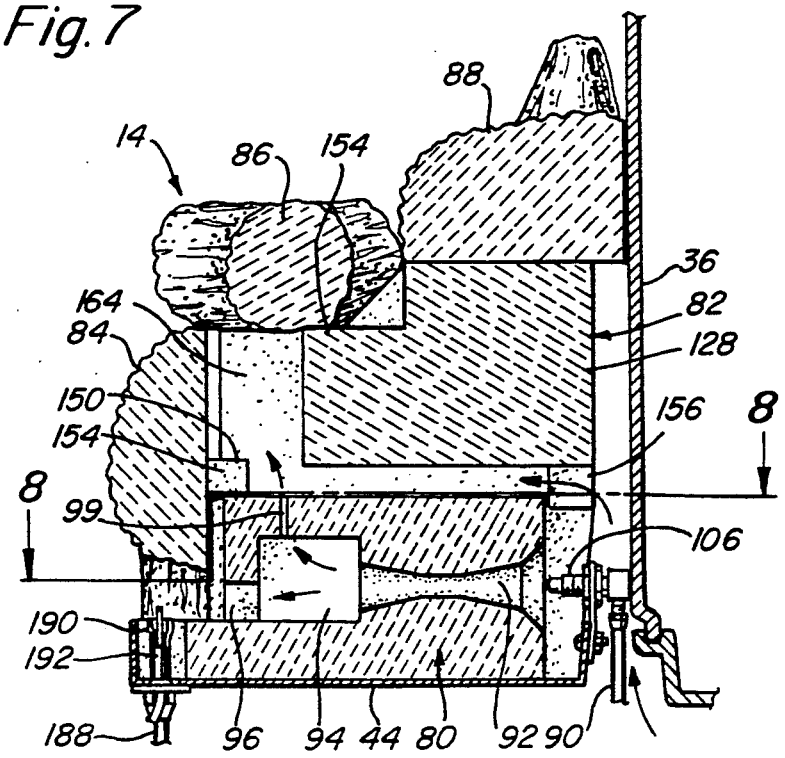
FIG. 7 is a cross sectional side view of the gas burner, support member and artificial log set taken along the line 7—7 of FIG. 5.
Figure 8:
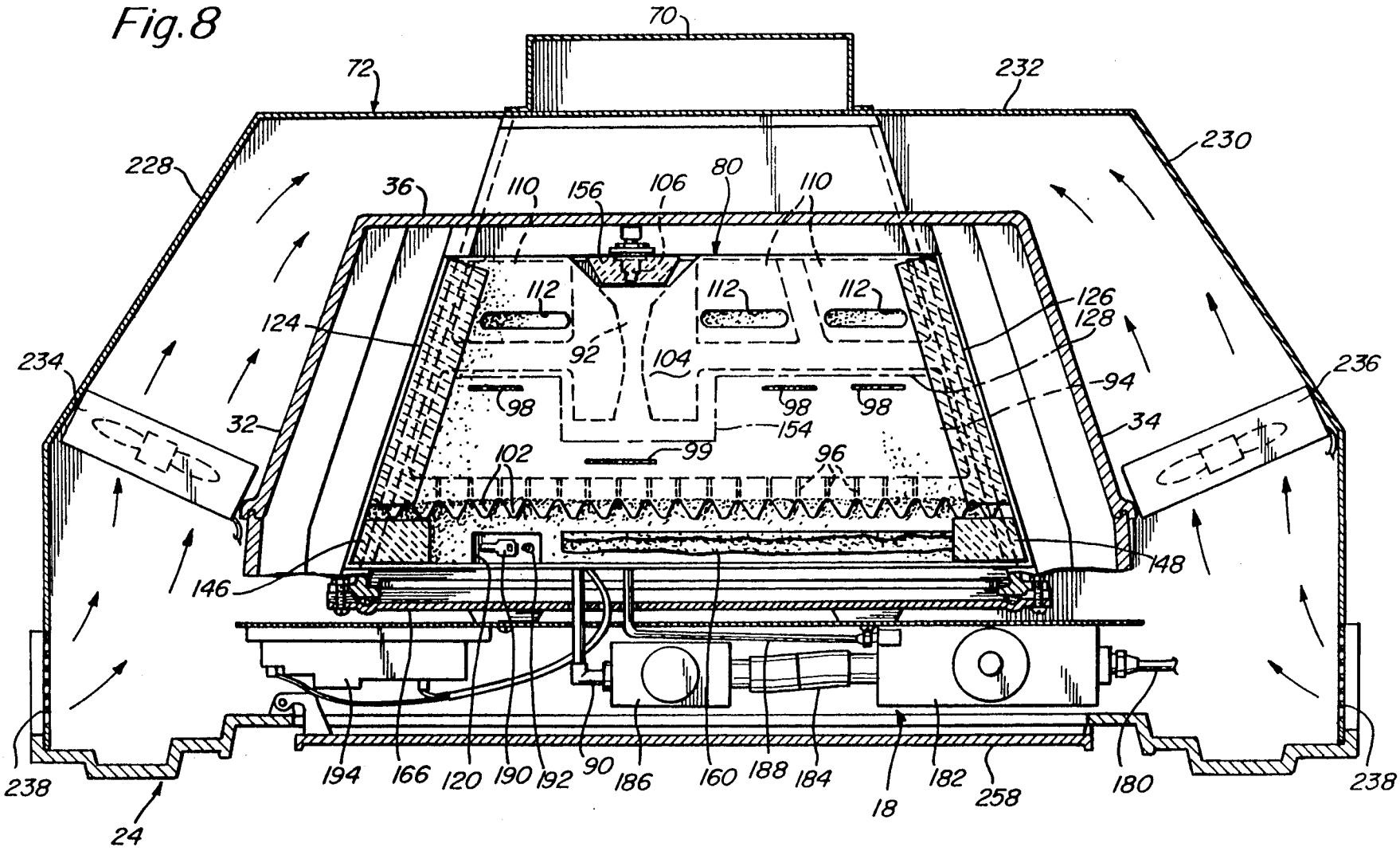
FIG. 8 is a cross-sectional top view of the gas log fireplace taken along the line 8—8 of FIG. 7.
Figure 9:
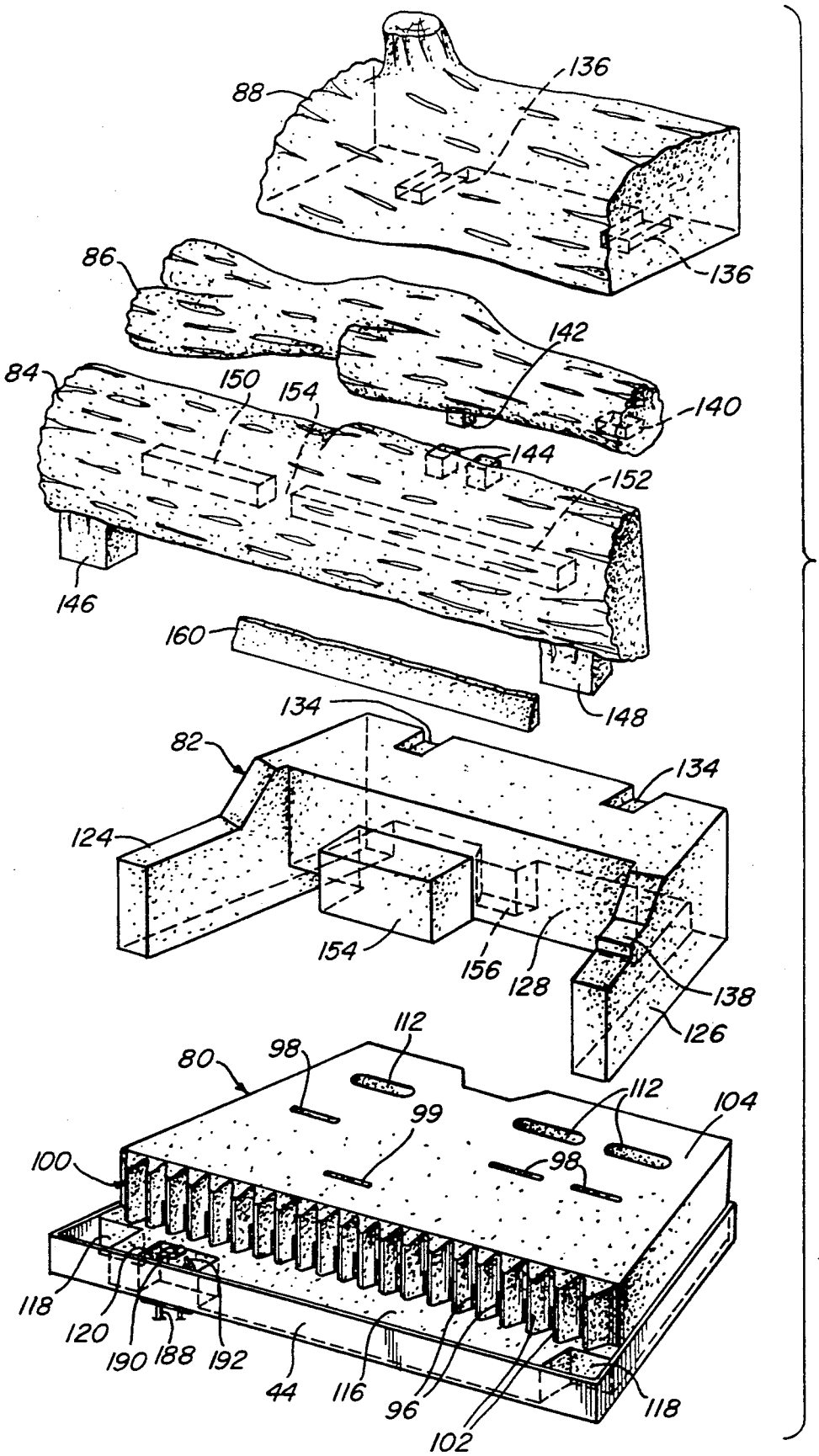
FIG. 9 is an exploded perspective view of the gas burner, support member and artificial log set.

In order to produce perfect gas combustion without carbon monoxide, a ratio of air to gas on the order of about 10:1 is required. In the gas log fireplace of the present invention, a portion of the required air is mixed with the gas that flows through inlet 92 into chamber 94. The remainder of the required air is provided as secondary air in a region near front ports 96 and a region near top ports 98 and 99. The secondary air is provided near the base of each flame and produces nearly complete combustion of the gas. One source of secondary air is provided by passages in gas burner 80. As best shown in FIGS. 6 and 8, recesses 110 are formed in a rear surface of gas burner 80. The recesses 110 are connected through slots 112 to the top surface 104 of the gas burner. As shown in FIG. 8, the slots 112 are located adjacent to top ports 98 and provide a flow of secondary air for complete combustion of the aerated gas emerging from top ports 98. It will be understood that the recesses 110 are isolated from the interior chamber 94 of gas burner 80.

The gas burner 80 further includes a base portion 116. The base portion 116 projects forwardly of front surface 100 beneath front ports 96 and includes recesses 118 for location of top log 86 and a recess 120 for mounting of a flame sensor burner and an electrode/sensor.

The support member 82 is formed of a refractory fiber material and is preferably fabricated of the same material as gas burner 80. The support member 82 includes side walls 124 and 126 and a rear wall 128 extending between and attached to side walls 124 and 126. The side walls 124 and 126 extend forwardly from rear wall 128 and rest on the top surface 104 of gas burner 80 at opposite ends thereof. The rear wall 128 is spaced from top surface 104, as best shown in FIG. 6, and defines an opening 130 for flow of additional secondary air. The support member 82 further includes a forwardly extending projection 154 from rear wall 128 between side walls 124 and 126. The projection 154 supports the top log 86 and assists in directing the flames from top ports 98 and 99 in desired directions. A downwardly extending projection 156 from rear wall 128 engages a recess in the top surface 104 of gas burner 80 for location of support member 82 relative to gas burner 80.

The back log 88 of the artificial log set rests on rear wall 128 of support member 82. A top surface of rear wall 128 has recesses 134 which engage projections 136 on the lower surface of back log 88 for proper location of back log 88 relative to support member 82.

The top log 86 of the artificial log set is supported by side walls 124 and 126 and projection 154 of support member 82. The front portions of side walls 124 and 126 are shorter than rear wall 128 so that top log 86 is positioned somewhat lower than back log 88. Side wall 126 has a recess 138 which engages a projection 140 on top log 86. Top log 86 also includes a projection 142 that is positioned between projections 144 on the rear surface of front log 84. Projections 140 and 142 locate the top log 86 in the artificial log set.

The front log 84 is positioned forwardly of the front surface 100 of gas burner 80 and includes projections 146 and 148 which engage recesses 118 in base portion 116 of gas burner 80. The front log 84 further includes ribs 150 and 152 on the rear surface thereof which rest on the top surface 104 of gas burner 80 for proper location of front log 84 relative to gas burner 80. A gap 154 between ribs 150 and 152 in the region of the flame sensor burner and the electrode/sensor permits cross-lighting of gas emerging from top ports 98 and 99.

The artificial log set preferably includes an ember strip 160 which is positioned forwardly of front ports 96 and below front log 84. The flames emerging from the front ports 96 heat ember strip 160, causing it to glow and to simulate glowing wood embers. The front log 84, the top log 86, the back log 88 and the ember strip 160 are preferably fabricated of vacuum formed refractory fiber material.

The artificial log set, the support member 82 and the gas burner 80 define a partially-enclosed cavity 164. The cavity 164 is defined primarily by the top surface 104 of gas burner 80, the rear surface of front log 84, the side walls 124 and 126 and the rear wall 128 of support member 82, and top log 86. By providing a combination of high temperature and sufficient oxygen within cavity 164, the fireplace of the present invention generates a high heat output and operates with high combustion efficiency. A high temperature, on the order of 1300° F.–1800° F., is maintained within cavity 164 by reradiation from the refractory insulating surfaces of the artificial log set, the support member 82 and the gas burner 80. These surfaces are sufficiently hot to glow during operation and simulate glowing coals underneath the artificial log set.

Oxygen for combustion of the gas is provided by primary air entrained with the combustible gas that flows through gas burner 80. Secondary air is provided through slots 112 to cavity 164 near the aerated gas emerging from top ports 98 and 99. Additional secondary air is provided through opening 130 between gas burner 80 and rear wall 128. The secondary air is directed into cavity 164 near the base of the flames. The primary air and the secondary air provided to cavity 164 enable nearly complete combustion of gas in cavity 164. The primary air for gas burner 80 and the secondary air that is drawn into cavity 16 flows from air inlet 54 through a space 168 between burner pan 44 and rear wall 36 of firebox 10, as best shown in FIG. 6. Although the temperature of the burner surface is on the order of 1200° C. or higher during operation, the insulating properties of the refractory fiber material ensure that the temperature in the interior chamber 94 of gas burner 80 is on the order of 200° F. The relatively low temperature within interior chamber 94 prevent flashback, or ignition, of the aerated gas within chamber 94.

Secondary air is also provided to the aerated gas which emerges from front ports 96. The secondary air flows from firebox air inlet 54 beneath burner pan 44 to the front portion of the firebox and then flows upwardly between burner pan 44 and a front panel 166 of firebox 10 below window 38 to the region of front ports 96. The secondary air is directed near the base of the flames. The aerated gas emerging from front ports 96 is thus burned with high efficiency.

Secondary air flowing through opening 130 meets the aerated gas flowing through top ports 98, 99 at 90° to insure efficient mixing of air and gas. Secondary air flowing upwardly in the region of front ports 96 meets the aerated gas flowing through front ports 96 at 90° to insure efficient mixing of air and gas. The perpendicular meeting of aerated gas and secondary air is believed to be a significant factor in achieving high efficiency.

In addition to providing high heat output and high combustion efficiency, the artificial log and gas burner assembly 14 produces a realistic flame pattern. The flame pattern includes flames 170 between top log 86 and back log 88, flames 172 forwardly of top log 86 and flames 176 which emerge from the bottom of front log 84 and extend upwardly in front of front log 84.

The gas control assembly 18 provides a combustible gas to gas burner 80 and controls a flame sensor burner. When the fireplace is turned off, the gas control assembly 18 ensures that no gas is permitted to enter the fireplace. Gas from a suitable source is provided through a gas line 180 to a redundant gas valve 182. A gas line 184 is connected from redundant gas valve 182 to a two rate valve 186. The output of two rate valve 186 is connected through main gas line 90 to nozzle 106 at the rear of gas burner 80. A second output of the redundant gas valve 182 is connected through a gas line 188 to a flame sensor burner 190 located forwardly of front ports 96 in the recess 120 in base portion 116 of gas burner 80. An electrode/sensor 192 is positioned adjacent to flame sensor burner 190 and is electrically connected to a spark generator 194. The redundant gas valve 182, the two rate valve 186 and the spark generator 194 are located in a compartment at the bottom front of the gas log fireplace.

The flame sensor burner 190 is metallic and completes an electrical circuit from the electrode/sensor 192. When a flame is present between electrode/sensor 192 and flame sensor burner 190, the ionized gas in the flame causes the applied voltage to be rectified and produces a DC voltage. The DC voltage indicates the presence of a flame. Typically, the flame is sensed between the electrode/sensor 192 and a conductive burner surface. Since the burner 80 in the present invention is fabricated of an insulating material, flame sensor burner 190 is positioned adjacent to electrode/sensor 192 to provide a complete electrical circuit for flame sensing.

Figure 3:
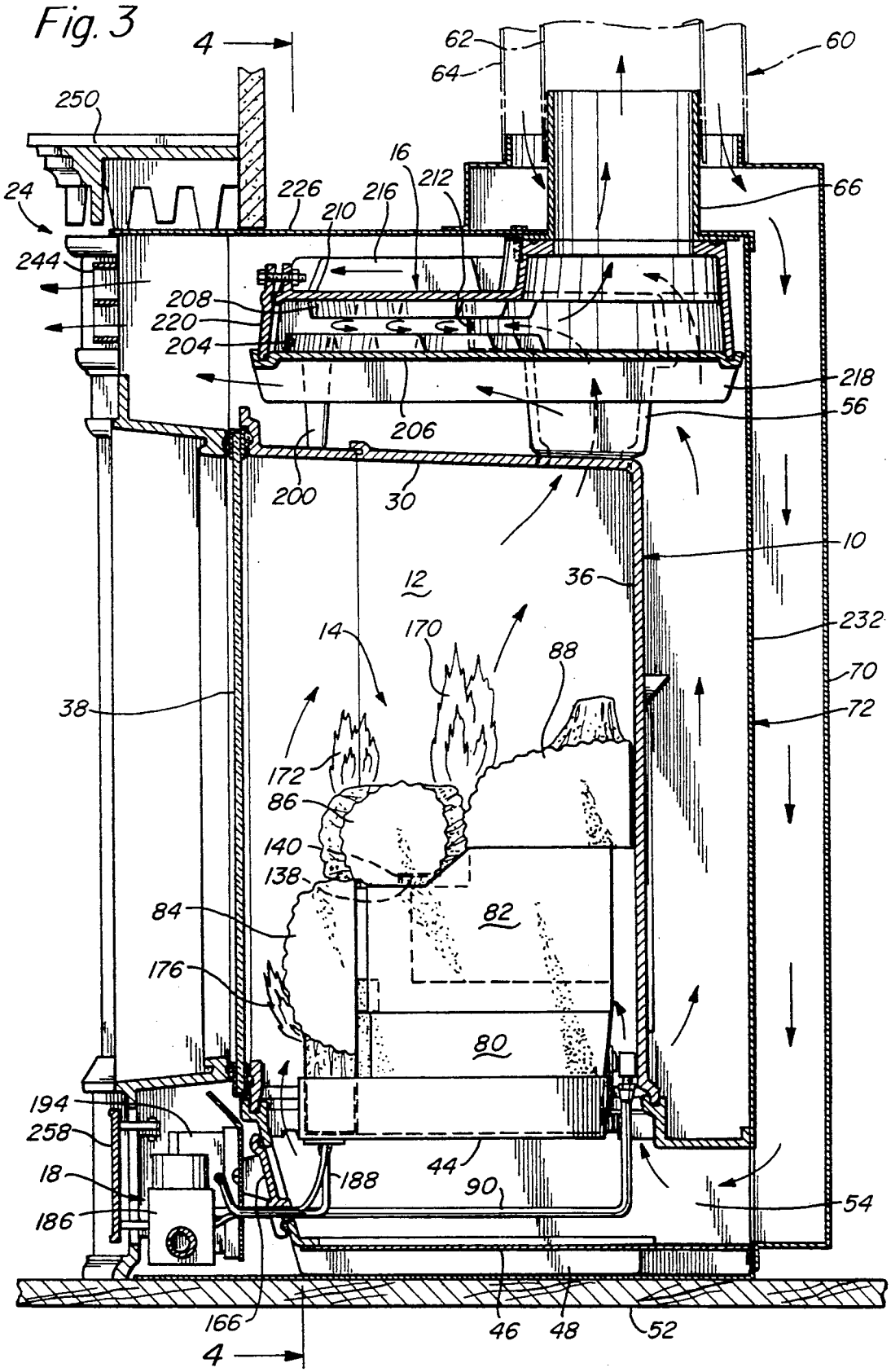
FIG. 3 is a cross-sectional side view of the gas log fireplace taken along the line 3—3 of FIG. 2.
Figure 4:
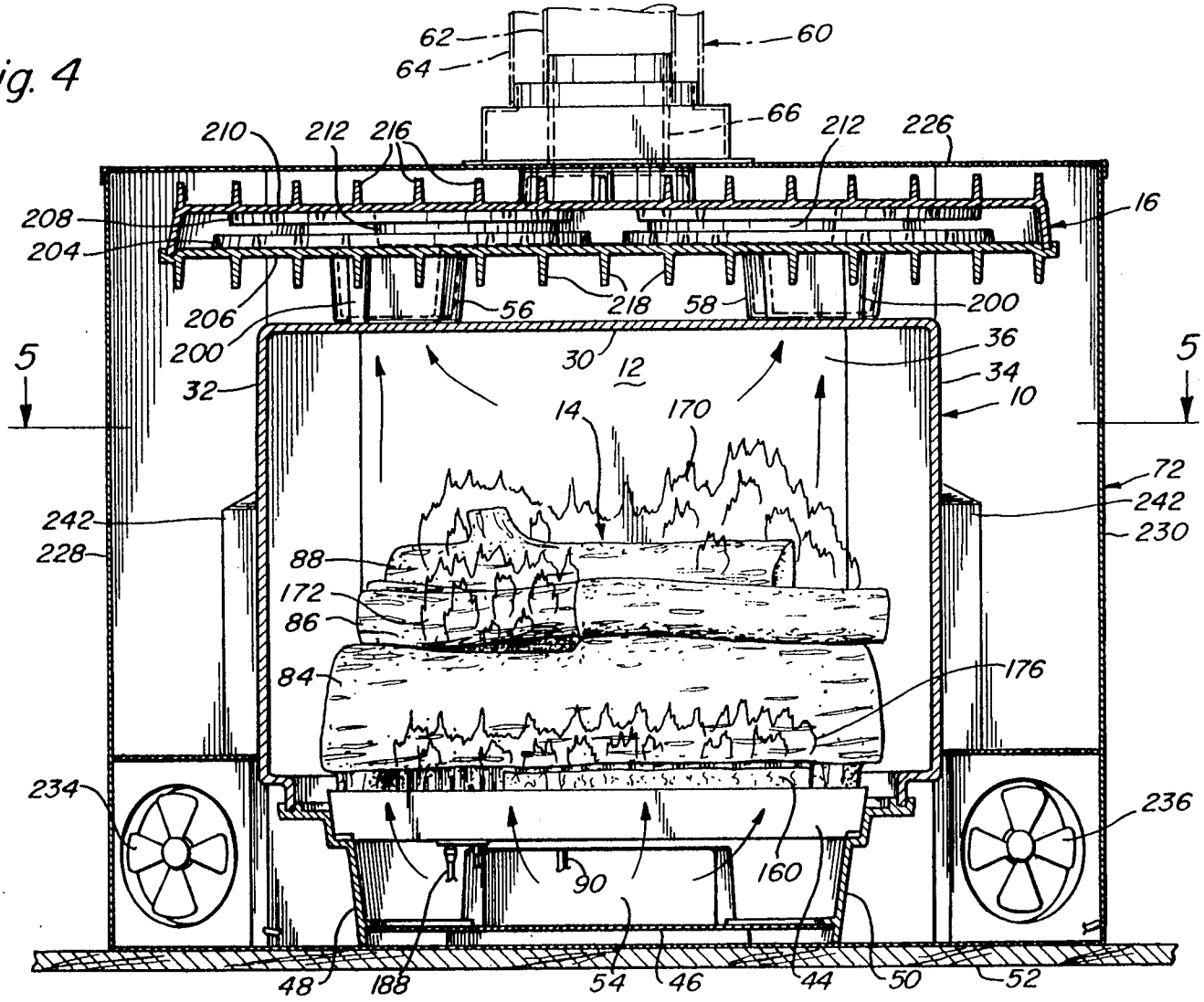
FIG. 4 is a cross-sectional front view of the gas log fireplace taken along the line 4—4 of FIG. 3.
Figure 5:
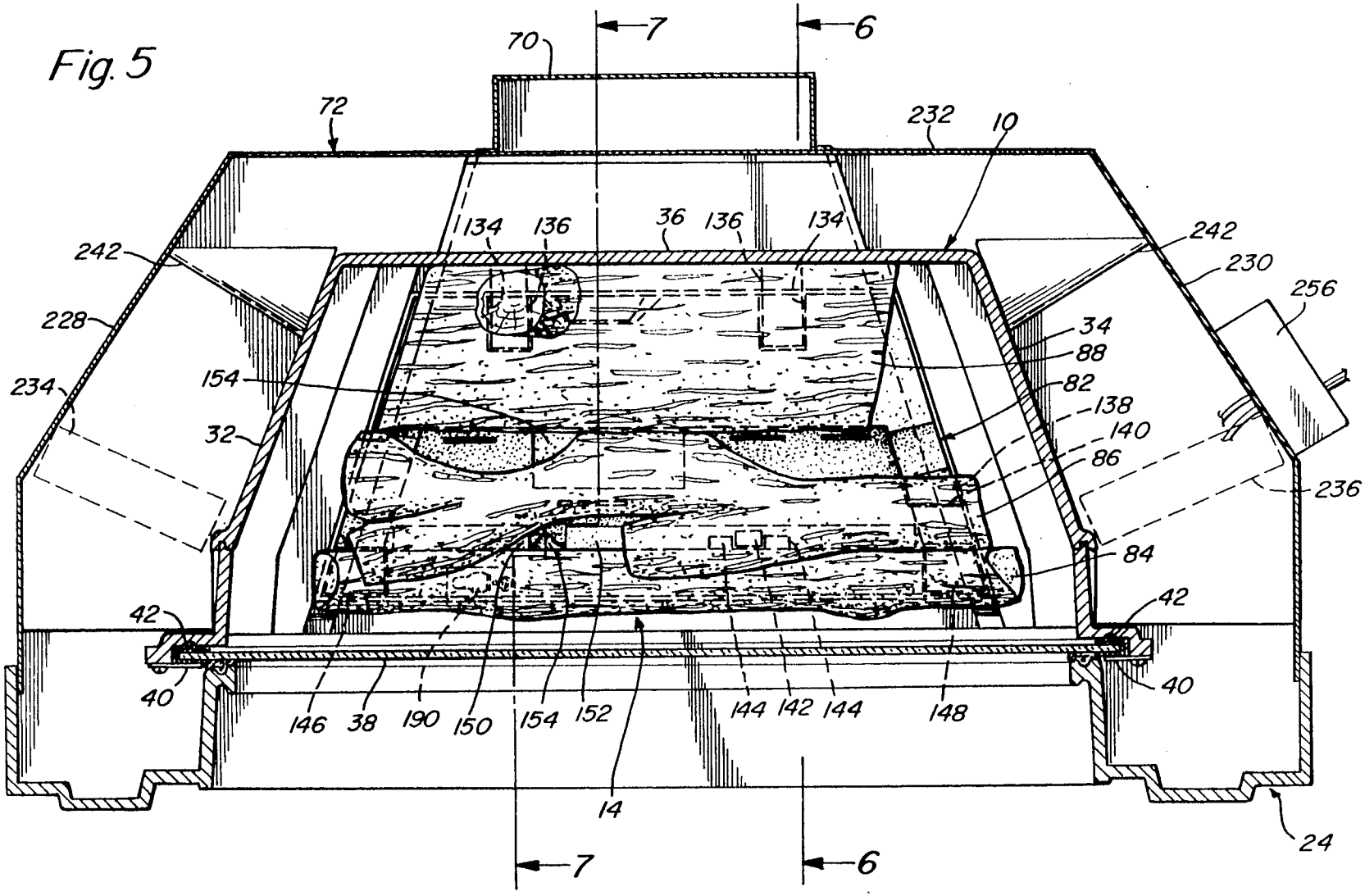
FIG. 5 is a cross-sectional top view of the gas log fireplace taken along the line 5—5 of FIG. 4.

The heat exchanger 16 is mounted above firebox 10 and is supported on top wall 30 by standoffs 200 and exhaust gas pipes 56 and 58, as best shown in FIGS. 3 and 4. Exhaust gases from combustion chamber 12 pass through exhaust pipes 56 and 58 into heat exchanger 16. The inner pipe 62 of vent pipe 60 is connected to the exhaust gas outlet 66 of heat exchanger 16.

Figure 2:
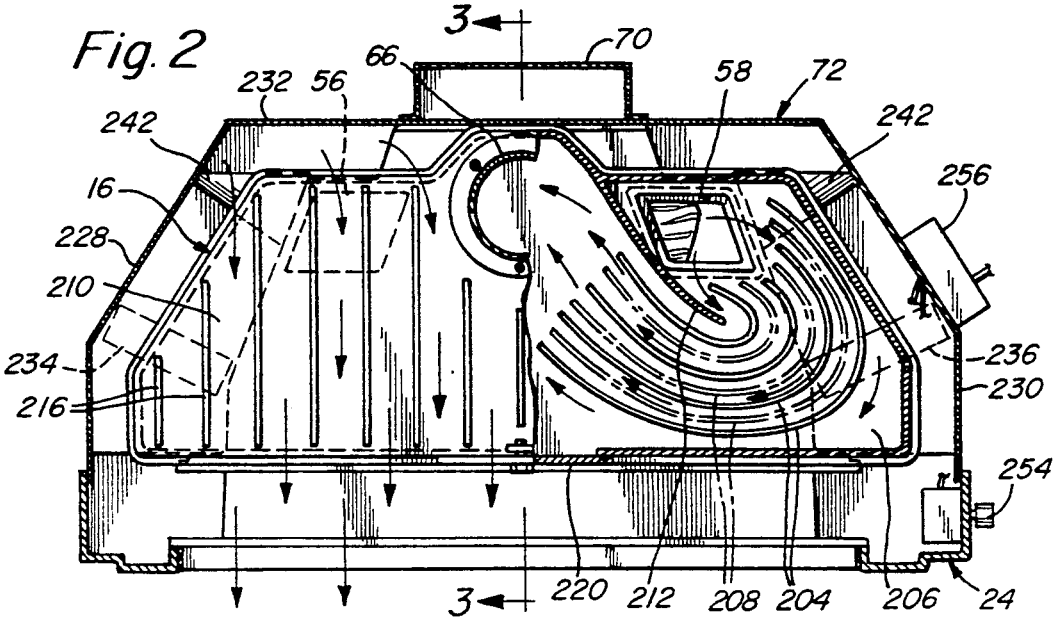
FIG. 2 is a cross-sectional top view of the gas log fireplace taken along the line 2—2 of FIG. 1, with the heat exchanger partially broken away to show the interior rib configuration.

As best shown in FIG. 2, the heat exchanger 16 includes an interior rib configuration which extends the residence time of exhaust gases within the heat exchanger. Arcuate, parallel bottom ribs 204 extend from each of the exhaust pipes 56, 58 to exhaust gas outlet 66. The bottom ribs 204 extend upwardly from a bottom wall 206 of a heat exchanger housing. Arcuate, parallel top ribs 208 also extend from each of the exhaust pipes 56, 58 to exhaust gas outlet 66. The top ribs 208 extend downwardly from a top wall 210 of the heat exchanger housing. The bottom ribs 204 and the top ribs 208 are interleaved, as shown in FIG. 2, and direct exhaust gases over a major portion of bottom wall 206 and top wall 210 so as to enhance heat transfer through the walls of the heat exchanger 16. The bottom ribs 204 and the top ribs 208 preferably have a height that is about 45% of the spacing between bottom wall 206 and top wall 210. A full height rib 212 is located between the exhaust gas outlet 66 and each of the exhaust pipes 56, 58 to prevent direct flow of exhaust gases therebetween. The full height rib 212 extends from bottom wall 206 to top wall 210 so that exhaust gases are channeled in the direction defined by bottom ribs 204 and top ribs 208.

Parallel, spaced apart top fins 216 are located on the exterior surface of top wall 210, and parallel, spaced apart bottom fins 218 are located on the exterior surface of bottom wall 206. The fins 216 and 218 run generally from front to back in the fireplace and enhance the transfer of heat to room air without substantially impeding flow of convection air. The configuration of interior ribs 204, 208 and 212 and exterior fins 216 and 218 provides a highly efficient transfer of heat from the exhaust gases to room air flowing over the heat exchanger 16. The heat exchanger 16 includes a removable panel 220 that can be used for cleaning the heat exchanger interior.

Room air circulates through a passage or chamber between the outer shell 72 and the outer surfaces of firebox 10 and heat exchanger 16. The outer shell 72 includes a top wall 226, side walls 228 and 230 and a back wall 232, each typically fabricated of sheet metal. The passages for circulation of room air are configured to optimize the flow of room air due to natural convection without sacrificing effective heat transfer when fans are used. Either forced or natural convection can be used for transfer of heat to room air. As best shown in FIG. 4, an optional fan 234 is located between side wall 32 of firebox 10 and side wall 228 of outer shell 72. An optional fan 236 is located between side wall 34 of firebox 10 and side wall 230 of outer shell 72. Fans 234 and 236 are preferably located near the bottom of the fireplace. Cool room air is drawn by fans 234 and 236 into the fireplace through louvers 238 and 240 located on each side of the front of the fireplace. Room air is also drawn into the fireplace through spaces around a hinged access door 258 located below window 38. The cool air is directed by forced or natural convection rearwardly through the space between outer shell 72 and firebox 10 and is warmed by firebox 10. Near the rear of firebox 10, air deflectors 242 deflect the heated air upwardly over the rear wall 36 of firebox 10 to heat exchanger 16. The heated air then passes over the outer surfaces of heat exchanger 16 and is directed forwardly by top fins 216 and bottom fins 218 toward the front of the fireplace. Room air is further heated as it passes over heat exchanger 16 and then flows back into the room through a louver 244 located near the top of the fireplace. In a preferred embodiment, the fans 234 and 236 are rated at about 150 cubic feet per minute. However, the fans are not necessary for efficient operation.

The mantel assembly 24 of the fireplace which projects into the room includes louvers 238, 240 and 244 for circulating and heating of room air as described above. The mantel assembly 24 further includes a decorative mantel 250, a switch and variable speed control 252 for fans 234 and 236, and a switch 254 for gas control. The gas control switch 254 has off, high heat and low heat positions. The switch 254 is electrically connected to the gas valves 182 and 186 and to the spark generator 194 to control these devices. An electrical junction box 256 is mounted to the exterior of outer shell 72 to provide the necessary electrical power for operation of fans 234 and 236 and the gas control assembly 18. The hinged access door 258 permits access to the gas control assembly 18.

In the high heat setting, the gas log fireplace shown and described above has a gas flow rate of 36,000 BTU's/hour, a heat output of 29,000 BTU's/hour and an efficiency of about 80%. In the low heat setting, the fireplace has a gas flow rate of 30,800 BTU's/hour, a heat output of 24,000 BTU's/hour and an efficiency of about 78%. The efficiency is defined as U.S. Department of Energy annual fuel utilization efficiency.

The present invention has been described herein as a gas log fireplace. It will be understood that the artificial log and gas burner assembly 14 shown and described above can be utilized in other gas appliances. For example, the artificial log and gas burner assembly 14 can be utilized in a free standing fireplace or stove to simulate burning wood logs and to provide high heat output and high combustion efficiency.

While there have been shown and described what are at present considered the preferred embodiments of the present invention, it will be obvious tc those skilled in the art that various changes and modifications may be made therein without departing from the scope of the invention as defined by the appended claims.

What is claimed is:

1. A gas log fireplace comprising:

a firebox defining a combustion chamber and including an air inlet and an exhaust gas outlet;

a gas burner located within said firebox, said gas burner comprising a refractory fiber insulating body having a plurality of front ports in a front surface thereof, a plurality of top ports in a top surface thereof, an inlet for receiving a combustible gas and primary air, and an interior chamber connecting said inlet to said front ports and to said top ports;

means for supplying a combustible gas to the inlet of said gas burner;

a support member comprising a refractory fiber insulating body positioned on said gas burner;

an artificial log set at least partially supported by said support member and positioned relative to said gas burner and said support member so that said log set, said support member and said gas burner define a partially enclosed cavity, the top ports of said gas burner being positioned to direct aerated combustible gas into said cavity;

means for directing secondary air from the air inlet of said firebox to said cavity so that said aerated combustible gas is efficiently burned in said cavity;

a heat exchanger connected to the exhaust gas outlet of said firebox for receiving exhaust gas from said combustion chamber; and means for directing room air over said firebox and said heat exchanger for heating of the room air.

2. A gas log fireplace as defined in claim 1 wherein said artificial log set includes a front log positioned at least in part forwardly of the front surface of said gas burner, and a top log and a back log resting on said support member.

3. A gas log fireplace as defined in claim 2 wherein said support member comprises a pair of side walls and a rear wall extending between and attached to said side walls, said side walls extending forwardly from said rear wall, said side walls and said rear wall in part defining said cavity.

4. A gas log fireplace as defined in claim 3 wherein the rear wall of said support member is spaced from the top surface of said gas burner to define an opening therebetween, and wherein said means for directing secondary air to said cavity comprises said opening between the rear wall of said support member and the top surface of said gas burner.

5. A gas log fireplace as defined in claim 4 wherein said support member further includes a projection that extends forwardly from said rear wall between said side walls for support of said top log and for directing flames in a desired direction.

6. A gas log fireplace as defined in claim 2 wherein each log of the log set includes at least one projection for positioning of the log relative to the support member or the gas burner.

7. A gas log fireplace as defined in claim 3 wherein said top log rests on said side walls and said back log rests on said rear wall.

8. A gas log fireplace as defined in claim 4 wherein said means for directing secondary air to said cavity further comprises at least one passage extending from a rear surface of said gas burner to the top surface of said gas burner adjacent to said top ports for enhancing flow of secondary air to said cavity.

9. A gas log fireplace as defined in claim 2 wherein the front ports of said gas burner are vertically oriented and are spaced apart along the front surface of said gas burner below said front log, said front ports being positioned to direct aerated combustible gas into a region below said front log.

10. A gas log fireplace as defined in claim 9 further including means for directing secondary air from the air inlet of said firebox to the region of said front ports below said front log so that the aerated combustible gas passing through said front ports is efficiently burned.

11. A gas log fireplace as defined in claim 10 wherein said gas burner further includes a forwardly extending vertical rib between each pair of said front ports so that each of said front ports provides a substantially independent flame.

12. A gas log fireplace as defined in claim 11 wherein said artificial log set further includes an ember strip positioned forwardly of the front ports in said gas burner for providing a decorative ember like glow and for reradiating heat to the region of said front ports.

13. A gas log fireplace as defined in claim 1 wherein the overall efficiency is at least 78%.

14. A gas log fireplace as defined in claim 1 wherein the heat output is at least 24,000 BTU s per hour.

15. A gas log fireplace as defined in claim 1 further including a flame sensor burner and an electrode/sensor for igniting said combustible gas and for sensing flames from said gas burner, said flame sensor burner being positioned to complete an electrical circuit with said electrode/sensor.

16. A gas log fireplace as defined in claim 1 wherein heat is reradiated by said artificial log set, said support member and the top surface of said gas burner so that said cavity is maintained at a temperature on the order of 1300° F.–1800° F. during operation.

17. A gas log fireplace as defined in claim 1 wherein said means for directing room air over said firebox and said heat exchanger includes means defining at least one passage contacting an outer surface of said firebox and an outer surface of said heat exchanger for convection of room air through said passage.

18. A gas log fireplace as defined in claim 1 wherein said heat exchanger includes a housing defining an interior region for flow of exhaust gases, at least one exhaust gas inlet connected to said firebox and an exhaust gas outlet, said housing including a top wall having a first plurality of arcuate, parallel top ribs extending between the exhaust gas inlet and the exhaust gas outlet of said heat exchanger for directing exhaust gas through a major portion of the interior region of said housing, said housing further including a bottom wall having a second plurality of arcuate, parallel bottom ribs extending between the exhaust gas inlet and the exhaust gas outlet of said heat exchanger for directing exhaust gas through the major portion of the interior region of said housing, said top ribs and said bottom ribs being interleaved with each other.

19. A gas log fireplace as defined in claim 18 wherein said heat exchanger further includes a full height rib extending from said top wall to said bottom wall between said exhaust gas inlet and said exhaust gas outlet for preventing direct flow of exhaust gas from the exhaust gas inlet to the exhaust gas outlet of said heat exchanger.

20. A gas log fireplace as defined in claim 19 wherein said heat exchanger further includes exterior fins for enhancing transfer of heat to said room air without substantially impeding flow of convection air.

21. A gas log fireplace as defined in claim 1 further including means for igniting said combustible gas.

22. A gas log appliance comprising:

a firebox defining a combustion chamber and including an air inlet and an exhaust gas outlet;

a gas burner located within said firebox, said gas burner comprising a refractory fiber insulating body having a plurality of front ports in a front surface thereof, a plurality of top ports in a top surface, an inlet for receiving a combustible gas and primary air, and an interior chamber connecting said inlet to said front ports and to said top ports;

means for supplying a combustible gas to the inlet of said gas burner;

a support member comprising a refractory fiber insulating body positioned on said gas burner;

an artificial log set at least partially supported by said support member and positioned relative to said gas burner and said support member so that said log set, said support member and said gas burner define a partially enclosed cavity, the top ports of said gas burner being positioned to direct aerated combustible gas into said cavity; and means for directing secondary air from the air inlet of said firebox to said cavity so that said aerated combustible gas is efficiently burned in said cavity.

23. A gas log appliance as defined in claim 22 wherein said artificial log set includes a front log positioned at least in part forwardly of the front surface of said gas burner, and a top log and a back log resting on said support member.

24. A gas log appliance as defined in claim 23 wherein said support member comprises a pair of side walls and a rear wall extending between and attached to said side walls, said side walls extending forwardly from said rear wall, said side walls and said rear wall in part defining said cavity.

25. A gas log appliance as defined in claim 24 wherein the rear wall of said support member is spaced from the top surface of said gas burner to define an opening therebetween and wherein said means for directing secondary air to said cavity comprises said opening between the rear wall of said support member at the top surface of said gas burner.

26. A gas log appliance as defined in claim 25 wherein said means for directing secondary air to said cavity further comprises at least one passage extending from a rear surface of said gas burner to the top surface of said gas burner adjacent to said top ports for enhancing flow of secondary air to said cavity.

27. A gas log appliance as defined in claim 22 wherein heat is reradiated by said artificial log set, said support member and the top surface of said 1 gas burner so that said cavity is maintained at a temperature on the order of 1300° F.-1800° F. during operation.

* * * * *